US006402889B1

(12) United States Patent
Gwosdz-Kaupmann et al.

(10) Patent No.: US 6,402,889 B1
(45) Date of Patent: Jun. 11, 2002

(54) CALENDER WEB THREADING DEVICE AND METHOD

(75) Inventors: Michael Gwosdz-Kaupmann, Krefeld; Thomas Hermsen, Issum; Reinhard Wenzel, Krefeld; Franz Kayser, Geldern, all of (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/495,894

(22) Filed: Feb. 2, 2000

(30) Foreign Application Priority Data

Feb. 3, 1999 (DE) ..... 199 04 180

(51) Int. Cl.[7] ..... D21G 1/00

(52) U.S. Cl. ..... 162/193; 100/162 R; 100/173; 226/92

(58) Field of Search ..... 162/193, 255, 162/286, 289, 358.1, 360.2, 360.3; 100/161, 162 R, 163, 166, 173; 226/91, 92, 50, 4; 425/363

(56) References Cited

U.S. PATENT DOCUMENTS 327,031 A * 9/1885 Smith ..... 100/166
3,985,488 A * 10/1976 Hoffmann ..... 425/363
3,999,696 A * 12/1976 Reba et al. ..... 226/7
4,763,822 A * 8/1988 Mohrsen ..... 226/91
5,001,976 A * 3/1991 Scheurer et al. ..... 100/45
5,333,544 A * 8/1994 Conrad ..... 100/53
5,453,239 A * 9/1995 Fromm ..... 264/175
6,199,477 B1 * 3/2001 Brendel et al. ..... 100/162 R

FOREIGN PATENT DOCUMENTS

| | | | |
|---|---|---|---|
| DE | 36474 | 9/1985 | D21G/1/00 |
| DE | 3738973 | 5/1989 | D21G/1/02 |
| EP | 232689 | 8/1987 | D21G/9/00 |

* cited by examiner

*Primary Examiner*—Peter Chin
*Assistant Examiner*—Eric Hug
(74) *Attorney, Agent, or Firm*—Greenblum & Bernstein, P.L.C.

(57) ABSTRACT

A web guidance device for a calender and a method of threading a web through a calender. The web guidance device is for a roll stack having several rolls which form a plurality of nips, and includes a movable web guidance device which is fixable in at least one insertion position and arranged on at least one side of the roll stack, wherein the web guidance device guides a beginning of the web through the roll stack. The method is for threading a material web through a calender which has a roll stack having at least a first nip and a second nip, and includes feeding a web beginning through a first nip from one side of the roll stack, engaging the web beginning on the other side of the roll stack with a web guidance device, and guiding the web beginning to a second nip with the web guidance device.

60 Claims, 4 Drawing Sheets

CALENDER WEB THREADING DEVICE AND METHOD

CROSS-REFERENCE TO RELATED APPLICATIONS

The present application claims priority under 35 U.S.C. §119 of German Patent Application No. 199 04 180.6, filed on Feb. 3, 1999, the disclosure of which is expressly incorporated by reference herein in its entirety.

BACKGROUND OF THE INVENTION

1. Field of the Invention

The present invention relates to a method and device for threading a web through a calender with a roll stack having several rolls which form nips between one another for treating a material web.

While the exemplary embodiment of the invention describes a paper web as an example of a material web, it is noted that the invention is analogously applicable to other material webs that have to be treated in a calender.

The design of the rolls themselves is not significant to the present invention. Both "hard" as well as "soft" rolls can be used which alternate and these so-called "soft" nips or roll slits can therefore be formed. However, the calender can also have exclusively or predominantly hard rolls.

2. Discussion of Background Information

One type of calender is known from EP 0 232 689 A2.

Treating a paper web in a calender, known as glazing, takes place in many cases in off-line operation, i.e., the paper web is typically unwound by a reel spool, guided through the calender and then wound onto a new reel spool. Even if a so-called flying splice, i.e., a flying change between a used and new reel spool, is performed, from time to time it is necessary to guide the beginning of the paper web through the roll stack, for example, after the web has torn. This threading can take place manually which, as a rule, normally requires two members of the operating crew standing on either side of the roll stack. In this process, the paper web is folded together at its tip into an arrow shape and slid through the first nip. The operating crew member receives the paper web on the other side, guides it around reversing devices, as the case may be, such as guide rollers, and again inserts it into the next desired nip. This manual threading process is relatively time-consuming, laborintensive, and raises safety concerns. Even if the web of paper is moved in this case only at a relatively low speed of 10 to 20 m per minute, it can easily result in dangerous situations or even accidents.

In an effort to address these concerns, EP 0 232 689 A2 discloses the possibility of automating the insertion of the paper web. To do this, a web guidance device having a guide surface as well as a blower device is always arranged between two nips, i.e., always on one roll. The web hitting the guide surface is then slid along the guide surface in the desired direction with the aid of the blower device.

A calender structured in this way can be operated automatically in a certain respect. The danger that accidents to persons will occur during threading is also considerably less. However, the effort and thus the costs for the web guidance device are very high. Complicating this further is that the accessibility of the calender during operation is dramatically restricted. If a web tears, something which cannot reliably be avoided in practice, the web guidance device can cause dangerous paper jams which can cause resulting damage to rolls and other devices. Moreover, this design obstructs the view of the running paper web and makes changing the roll more difficult.

SUMMARY OF THE INVENTION

The present invention reduces the possibility of malfunction in operation by utilizing a threading device.

In particular, the present invention provides a calender of the type mentioned at the outset that also includes a movable web guidance device, which can be fixed in at least one insertion position, arranged on at least one side of a roll stack.

"Side" in this case does not refer to the face, but rather to the front or rear side of the roll stack on which the material web must be reversed in order to be guided into the next desired nip.

Thus, the advantages of a mechanized system are exploited without having to accept its disadvantages. The web guidance device is available for threading the beginning of the material web into the calender. In this threading process, however, it is possible to make do with a far lower constructive cost because the web guidance device can be moved from one insertion position to the next one. If the tip of the material web has been inserted into a nip, the web guidance device has performed its function at this point and is no longer required there. In the time that the paper web on the other side of the roll stack needs to be reversed and inserted into the next nip, the web guidance device can be shifted or moved to the next nip in order to receive the tip of the material web and again transport itself to the next desired nip. Based on this movement of the paper guidance device, it is clear that in operation most of the nips are free from the web guidance device so that it cannot cause malfunctions in operation. Nevertheless, threading or inserting the material web can be widely automated or at least mechanized so that the danger of accidents to the operating personnel remains low.

In one embodiment the web guidance device is initially fixed in a parked position where no nip is covered by the web guidance device. In operation, the material web can be observed just like in a calender which has been threaded by hand. That is, the device should not obstrict the view of the web travel through the nips. As a result, monitoring possibilities are improved quite significantly and the possibility of malfunctions is reduced still further.

The invention incorporates a traverser which is arranged advantageously on the side of the roll stack and the web insertion device is fastened to the traverser. Traversers are present in many calenders at any rate, and they are typically used for maintenance purposes, for example, to detach or fasten bearings of rolls being replaced. They can also be used to assist in manually operated threading of paper webs. Thus, using a conventional traverser makes a transport medium for the web guidance device available without greater additional expense.

In another embodiment, position switches are provided along the path of movement, each of which is assigned to an insertion position wherein these switches. are connected with a drive control. As a result of this design, the movement of the web guidance device can be controlled automatically or at least semi-automatically. In operation, the web guidance device is moved into the position where it receives the tip of the material web and/or can pass it on to the next desired nip. The position is determined, for example, by the position switch. If the web guidance device is moved into the next position, it also actuates the position switch there and thus reports the arrival to the drive control. On the other hand, provisions can be made in the drive control so that the web guidance device does not have to stop at every position, such as when some nips are supposed to be skipped when treating the paper web.

The web guidance device may advantageously have a guide surface arrangement. The tip of the paper web impacts the guide surface arrangement and is. guided in the desired direction thereby. The structural expense in this connection is relatively low.

Here, it is preferred for the guide surface arrangement in this connection to have a modifiable form. The guide surface arrangement can then also be used as "soft." Thus, it is possible to guide the paper web either immediately into the next nip of the roll stack or to jump over several nips and guide the. paper web parallel to the roll stack if this is desired for the treatment of the paper web.

In this connection, it is particularly preferred for the guide surface arrangement to have an evenly formed surface running essentially parallel to the direction of movement of the traverser and a reversing surface that can be moved out of the evenly formed surface. As long as the reversing surface does not project beyond the evenly formed surface, the paper web will be guided essentially parallel to the roll stack, i.e., will be able to skip several nips. If, on the other hand, the reversing surface is moved out of the evenly formed surface, the paper web will be diverted in order to be inserted into the next nip.

Another embodiment is provided here in which the reversing surface is arranged on pivoted levers. The reversing surface will then be folded out, as it were.

In still another embodiment, provision is made for the reversing surface to be arranged on a sliding piece that can be displaced transverse to the direction of movement. Naturally, the two embodiments can also be combined, if this is useful for structural reasons or space considerations. While a change in the guide surface geometry is caused in the first case by a pivoting movement of the pivoted levers, the geometry is changed in the second case by a linear movement.

Another embodiment provides that the guide surface arrangement has at least. one tongue which can be displaced up to the roll stack. As a result, the paper web can be guided into the vicinity of the nips and, in many cases, even up to directly in front of the nip. In this connection, it is only required for the paper web to be supported until it comes to lie at an area of the lower roll of the nips in which further thrusting of the paper web is not obstructed or disturbed by a roll segment that is too steep.

According to another embodiment, which can be provided as an alternative to or in addition to the guide surface arrangement, the web guidance device has at least one gripper head which can be moved vertically away from the roll stack in a first motion segment, parallel to the roll stack in a second motion segment, and vertically towards the roll stack in a third motion segment. In this connection, these three movements need not absolutely occur completely separately from one another. They can also be combined in such a way that the entire movement of the gripper head corresponds approximately to a semicircle. The gripper head can grasp the paper web which is being advanced through the nip, pull it out of the roll stack, pull it to the next desired nip and re-thread it there. Compulsory guidance occurs as a result, which is particularly advantageous with thinner paper, because its stiffness is not sufficient in some cases to push it through the individual nips.

According to still another embodiment, the gripper head has a suction and/or a blower device. In this design, the gripper head does not have to be fed through a nip in order to thread the paper web. On the contrary, it can remain in front of the nip in order to suction the paper web there. If the gripper head holds the paper web ready in front of the next nip, it can release it and blow it through the nip with the aid of a blast of air.

The gripper head can also be rotated 180° around an axis running parallel to the axes of the rolls. This takes into account the fact that the beginning of the paper. web must change direction in the same way in order to be inserted into the next desired nip.

In this connection, it is especially preferred for the gripper head to grip the material web laterally. Then the twisting of the gripper head does not produce any deflection of the paper web at its tip. On the contrary, the paper web is guided through the nips relatively smoothly.

The threading device can also be used on roll stacks which are inclined. Precisely in the case of stacks of rolls that are diagonal, the problem of threading the paper web is especially aggravating. While it is still possible in many cases to reach the paper web from below without there being great danger to the operating personnel, it is no longer possible to do so as easily from above. The web guidance device facilitates this process greatly particularly at the traverser.

According to one aspect of the invention, there is provided a web guidance device for a calender which includes a roll stack having several rolls which form a plurality of nips, the device including a movable web guidance device which is fixable in at least one insertion position and arranged on at least one side of the roll stack, wherein the web guidance device guides a beginning of the web through the roll stack. The calender may be a material web treating calender. The web guidance device may be fixable in a parked position in which no nip is covered by the web guidance device. The device may further include a traverser coupled to the moveable web guidance device. The web guidance device may be fastened to the traverser. The device may further include position switches for detecting the position of the web guidance device, the position switches being connected with a drive control. The web guidance device may further include a guide surface arrangement. The guide surface arrangement may include moveable guide surfaces for guiding the web. The at least one moveable guide surface may be an evenly formed surface which runs essentially parallel to a stack plane, the stack plane running through a center axis of at least two rolls in the roll stack. The guide surface arrangement may further include a reversing surface extending from the evenly formed surface. The reversing surface may be moveable to a position parallel to the evenly formed surface. The reversing surface may be arranged on pivoted levers. The reversing surface may be arranged on a sliding piece which is moveable in a direction substantially perpendicular to the stack plane. The guide surface arrangement may further include at least one tongue for engaging the web beginning, the at least one tongue being moveable in a direction substantially perpendicular to a stack plane, the stack plane running through a center axis of at least two rolls in the roll stack.

The web guidance device may further include at least one moveable gripper head for engaging the web beginning. The gripper head may be moveable along a arcuate path relative to the stack plane. The gripper head may be moveable in a direction substantially perpendicular to a stack plane, the stack plane running through a center axis of at least two rolls in the roll stack. The gripper head may be moveable in a direction substantially parallel to the stack plane. The gripper head may include one of a suction and a blower device for engaging the web beginning. The gripper head may be rotatable for at least 180° around an axis running parallel to an axis of at least one roll in the roll stack. The gripper head may include jaws which are oriented substantially parallel to an axis of at least one roll in the roll stack.

The device may provide that the roll stack is inclined at an angle. The angle may be in the range of approximately greater than 0 degrees and less than 90 degrees.

The invention also provides for a device for threading a material web through a calender which has a roll stack having at least a first nip and a second nip, the device including a platform which is moveable relative to the roll stack and arranged on one side of the roll stack, and a web guidance device coupled to the platform, wherein the web guidance device is adapted to redirect the direction of the material web after the web passes through the first nip. The platform may include a traverser for carrying a operating personnel. The traverser is moveable in a direction parallel to a stack plane, the stack plane running through a center axis of at least two rolls in the roll stack. The web guidance device may include at least one pivoting lever having a guide surface for engaging the web. The web guidance device may include two pivoting levers each having a guide surface for engaging the web. The guide surface of each lever is curved whereby the web is guided to the second nip after reversing direction. The web guidance device may further include a linear guide coupled to the pivoting levers, the linear guide being oriented parallel to a stack plane, the stack plane running through a center axis of at least two rolls in the roll stack. The web guidance device may further include fluid activated cylinders for moving the pivoting levers. The web guidance device may also include at least one sliding mechanism having a guide surface for engaging the web. The web guidance device may provide that at least two sliding mechanisms each having a guide surface for engaging the web. The guide surface of each sliding mechanism may be curved whereby the web is guided to the second nip after reversing direction. The web guidance device may further include a linear guide coupled to the pivoting levers, the linear guide being oriented parallel to a stack plane, the stack plane running through a center axis of at least two rolls in the roll stack. The at least one sliding mechanism may further include a tongue disposed at one end of the at least one sliding mechanism for engaging the web, the tongue being retractable into the sliding mechanism. The web guidance device may include at least one guiding mechanism having an end for engaging the web. The guiding mechanism may include a connecting rod which is moveable in a direction substantially perpendicular to a stack plane, the stack plane running through a center axis of at least two rolls in the roll stack. The connecting rod may include a gripper head for engaging a beginning end of the web. The gripper head may include a pair of rotating jaws for reversing the direction of the web. The gripper head may have one of a suction and a blower device for engaging the web beginning. The platform may travel along a path which is parallel to a stack plane, the stack plane running through a center axis of at least two rolls in the roll stack. The path may further include position switches for detecting the position of one of the platform and the web guidance device. The position switches may be connected to a drive control device.

The invention also provides for a method of threading a material web through a calender which has a roll stack having at least a first nip and a second nip, the method includes feeding a web beginning through a first nip from one side of the roll stack, engaging the web beginning on the other side of the roll stack with a web guidance device, and guiding the web beginning to a second nip with the web guidance device. The web guidance device may be coupled to a moving platform. The guiding may further include reversing the direction of the web beginning. The engaging may further include gripping the web beginning with a gripper head disposed on the end of the web guidance device. The gripping may further include vacuum retaining the web beginning. The gripping may further include rotating the web beginning approximately 180 degrees. The engaging may further include pivoting at least one lever having a web guiding surface. The engaging may further include pivoting two levers each having a web guiding surface. The engaging may also include moving at least one sliding mechanism substantially perpendicular to a stack plane, the stack plane running through a center axis of at least two rolls in the roll stack.

The method may further include moving the web guidance device from a parked position to a first position for initially engaging the web beginning. The method may further include detecting the position of the web guidance device with position sensors disposed along a web guidance device travel path. The method may also provide that the first and second nips are separated in the roll stack by at least one intermediate nip. That the first and second nips are separated in the roll stack by at least two intermediate nips. That the first and second nips are separated in the roll stack by at least two intermediate nips.

According to still another aspect of the invention, there is provided a device for threading a material web through a calender which has a roll stack having at least a first nip and a second nip, the device including a platform which is moveable along a travel path, the travel path being parallel to a stack plane whereby the stack plane runs through a center axis of at least two rolls in the roll stack, a web guidance device coupled to the platform, the platform being arranged on one side of the roll stack, the path including position sensors for detecting the position of one of the platform and the web guidance device, and a mechanism disposed on the web guidance device for changing a first direction of the web exiting the first nip to a second direction entering the second nip.

The invention also contemplates a method of threading a material web through a calender which has a roll stack having at least a first nip and a second nip, the method including moving a web guidance device from a parked position to a first position adjacent the first nip, detecting the first position with a position sensor, feeding a web beginning through a first nip from one side of the roll stack, engaging the web beginning on the other side of the roll stack with the web guidance device, changing the direction of the web beginning with the guidance device, and moving the web guidance device back to a parked position.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

While the exemplary embodiment of the invention describes a paper web as an example of a material web, it is noted that the invention is analogously applicable to other material webs that have to be treated in a calender.

Moreover, the design of the rolls themselves is not significant to the present invention. Both "hard" as well as "soft" rolls can be used which alternate and these so-called "soft" nips or roll slits can therefore be formed. However, the calender can also have exclusively or predominantly hard rolls.

Figure 1:
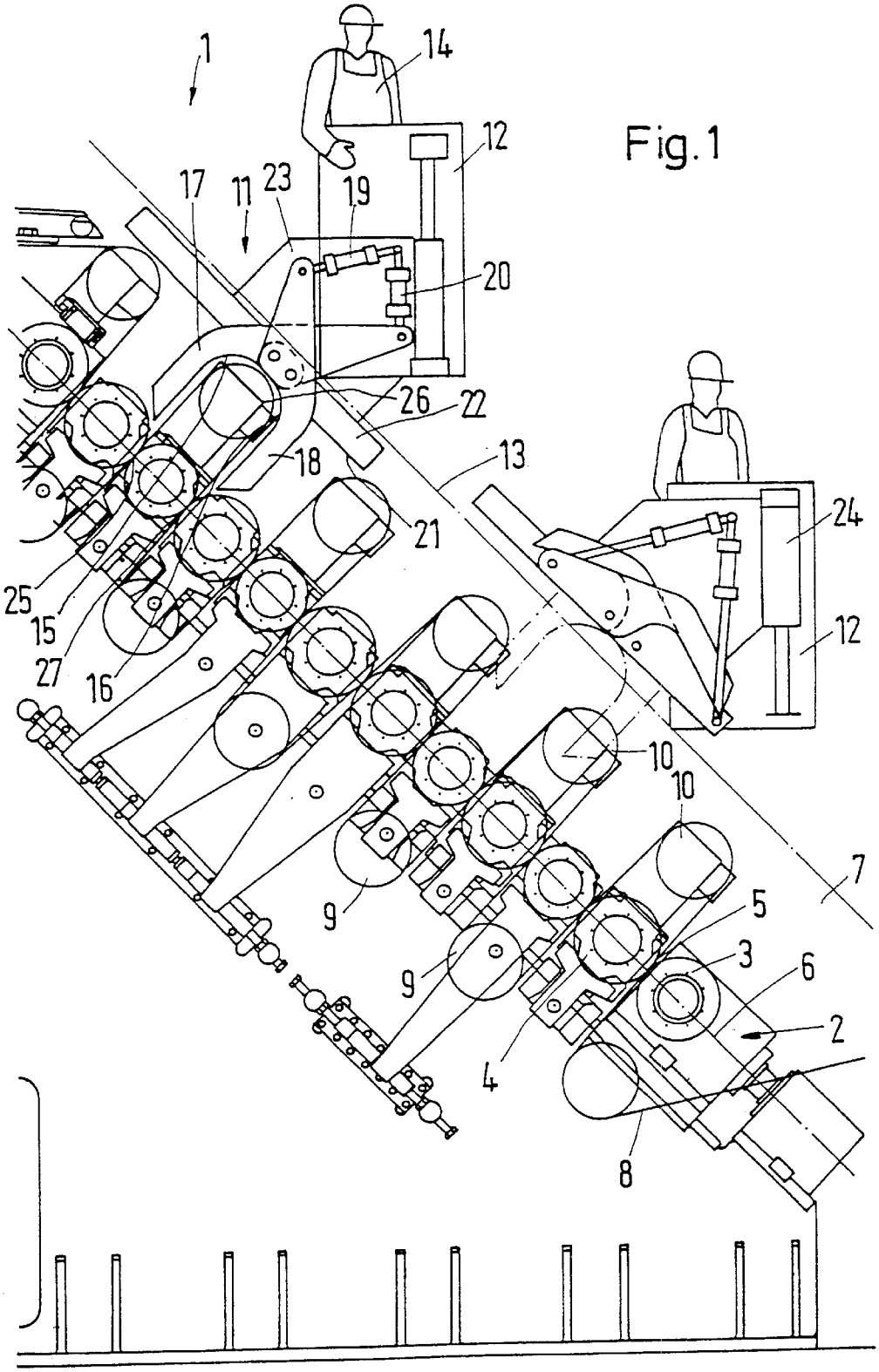
FIG. 1 shows a calender with a first embodiment of a web guidance device

FIG. 1 shows a calender 1 with a stack 2 of rolls 3, 4 which form nips 5 of roll slits between one another. In this case, the axes of rolls 3, 4 all lie on one plane 6. This plane 6 is inclined to the vertical direction in the present embodiment. Correspondingly, seating 7 of the calender is also inclined. Its edge essentially runs parallel to plane 6.

A paper web 8 is guided through roll stack 2, i.e., paper web 8 passes through all nips 5 of calender 1 in the depiction according to FIG. 1. Reversing rolls or guide rollers 9, 10 on which paper web 8 is diverted by approximately 180° are provided between individual nips.

Paper web 8 (or another corresponding material web) is acted upon in calender 1 with pressure and, as the case may be, also with increased temperature. The details required to control these influencing variables are shown to some extent, but will not be explained further in the following.

Before starting to treat paper web 8, it is necessary to guide paper web 8 through the nips in which treatment is desired. While the exemplary embodiment shows the web guided through all of the nips, it is also possible to plan for two or four. nips to be skipped.

A web guidance device 11 is provided in order to guide paper web 8 through the nips. Web guidance device 11 is arranged on a traverser 12 which can be displaced along a travel route 13. This type of traverser 12 is present in many calenders at any rate in order to give an operating person 14 the opportunity to conduct maintenance work such as cleaning rolls 3, 4 or making preparations to replace the rolls, for example.

Traverser 12 can be fixed in certain positions, which simultaneously creates a positioning possibility for web guidance device 11.

A corresponding traverser with a corresponding web guidance device can be provided on the opposing side of plane 6 of roll stack 2. However, this is not shown for overview reasons. On this "underside" of the calender 1, it is sufficient in many cases if only one traverser without a web guidance device is provided.

In the embodiment shown in FIG. 1, web guidance device 11 has a guide surface arrangement. First of all, the guide surface arrangement has curved guide surfaces 15, 16 which are attached to pivoted levers 17, 18. Pivoted levers 17, 18 can be pivoted with the aid of hydraulic or pneumatic cylinders 19, 20. In addition, an evenly formed surface 21 is provided on a linear guide 22. Pivoted levers 17, 18 can be withdrawn into the even surface 21, as shown in the lower traverser 12 position, or pivoted out from even surface 21, as shown in the upper traverser 12 position. Both linear guide 22 as well as pivoted levers 17, 18 are fastened on a common carrier 23, which can be lifted relative to traverser 12 with the aid of another cylinder 24. In the lifted state, the entire guide surface arrangement comes free from seating 7 of calender 1, allowing traverser 12 to be driven without interference.

In the upper position, traverser 12 hits a paper web tip being fed through nip 25 on curved surface 15 on pivoted lever 17 and is diverted around guide roller 26 by it until it hits curved surface 16. Pivoted lever 18 then guides the tip of the paper web to next nip 27. The time that is needed on the other side of roll stack 2 to receive the tip of the paper web, guide it around the next guide roller and insert it into the next nip, is sufficient for traverser 12 to travel one position further, such that, as mentioned, the guide surface arrangement is moved out of seating 7 before proceeding. The tip of paper web 8 moves during threading only at relatively low speeds of approximately 10 to 20 m per minute.

If skipping two nips behind nip 25 is desired, it is possible to fold out angle lever 18 so that the paper web then runs along evenly formed surface 21. After driving the lifting platform down by the desired number of positions, during which pivoted lever 17 has been folded out, pivoted lever 18 can then be pivoted in order to guide the tip of paper web 8 to the desired nip. It is also possible to intercept the tip of the paper web already with the upper end of evenly formed surface 21 if only two nips are supposed to be skipped and traverser 12 is already arranged in the correct position.

In a manner that is not depicted in more detail, all surfaces 15, 16, 21 can also have blower air support in which air is blown in the direction of the desired conveyance in order make it easier for the paper web to advance.

Figure 2:
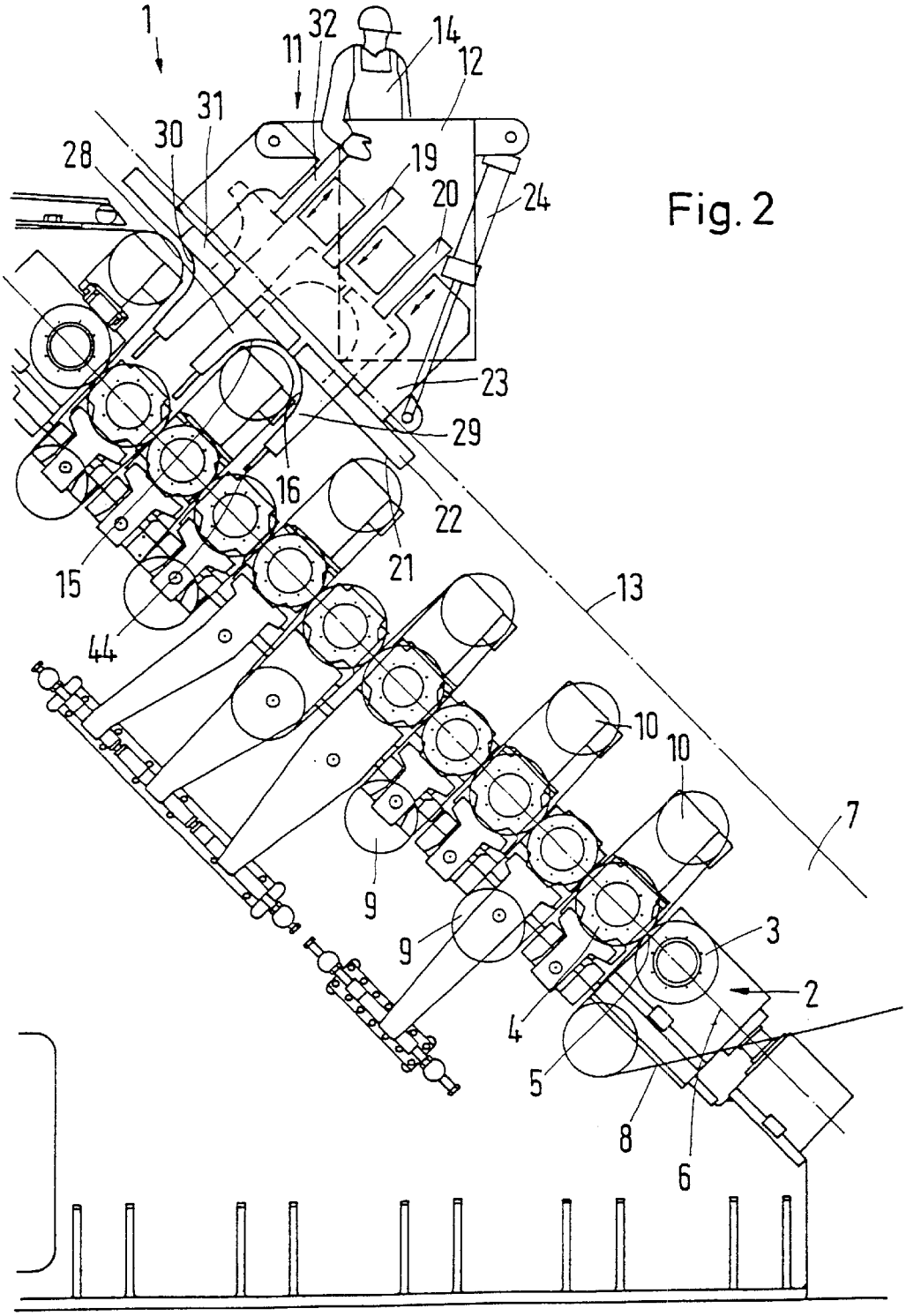
FIG. 2 shows a calender with a second embodiment of a web guidance device.

FIG. 2 shows a modified embodiment in which the same and corresponding parts are provided with the same reference numbers.

In contrast to the embodiment shown in FIG. 1, curved surfaces 15, 16 are no longer arranged on the pivoted levers, but rather on sliding pieces 28, 29 which are shown in the extended position with solid lines and the retracted position with a dashed line. In addition, another curved surface 30 is provided on a sliding piece 31. Cylinders 19, 20, 32 are provided for actuation and displace sliding pieces 28, 29, 31 against the carrier perpendicular to plane 6. In the retracted condition (shown as dashed lines), the incoming paper web is confronted only with evenly formed surface 21 on linear guide 22. The entire guide surface arrangement can be moved relative to traverser 12 with the aid of cylinder motor 24, which is also the case with the embodiment shown in FIG. 1.

A tongue 44 that can be pushed out can be present at the tip of sliding pieces 28, 29, 31, which is adjacent to roll stack 2. This tongue can be advanced to insert the paper web up to the arrangement on the corresponding roll so that the tip of the paper web can be advanced on a continuous guide surface up to the nip.

Evenly formed surface 21 and curved surfaces 15, 16, 30 can mesh like teeth, i.e., the surfaces are not formed continuously, rather are interrupted by slots parallel to the web travel direction, with the partial surfaces of a surface always being arranged in the slots of the other surfaces.

In the embodiment shown, the web guidance device can immediately handle two nips and receive the beginning of paper web 8 from a nip that lies in-between. This again saves time when threading paper web 8 into calender 1.

Figure 3:
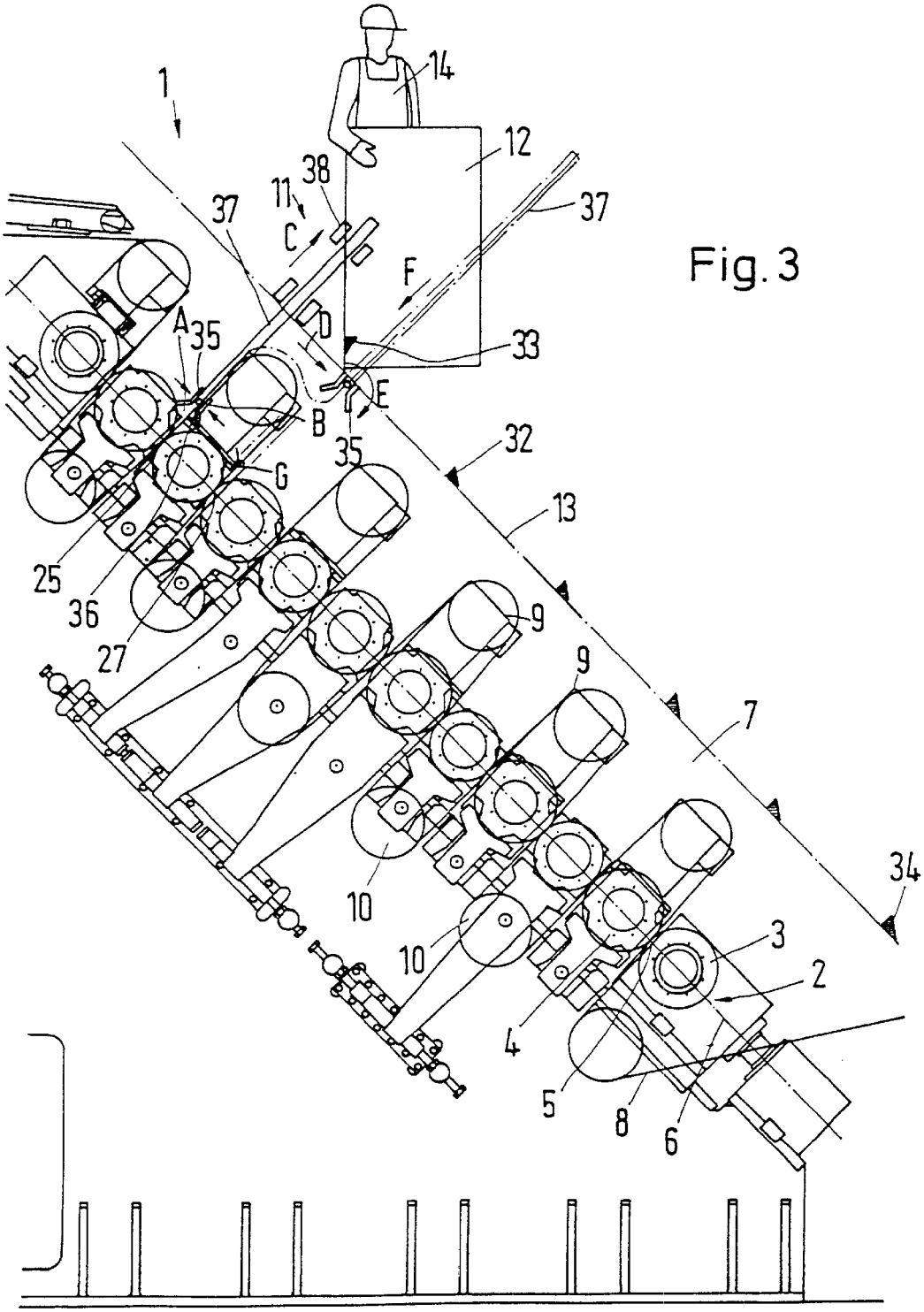
FIG. 3 shows a calender with a third embodiment of a web guidance device.

FIG. 3 shows another embodiment of a web guidance device in which the same and corresponding parts have been provided with the same reference numbers.

First of all, position switches 32 that are actuated by an actuating device 33 when traverser 12 reaches the corresponding position switch 32 have been arranged on travel route 13. A drive control that is not shown in more detail can shut down traverser 12. In this connection, a position switch 32 is assigned to every nip pair. Another position switch 34 is not assigned to any nip pair, rather identifies a parked position where the web guidance device no longer blocks the view of nips 5.

In contrast to the "passive" web guidance devices shown in FIGS. 1 and 2 in which the beginning of material web 8 is pushed over guide surfaces, the embodiment shown in FIG. 3 describes an "active" web guidance device. This is only depicted schematically in FIG. 3 in order to aid understanding of the mode of operation.

A gripper head 35 with a funnel-shaped opening 36 is located at the forward end of a connecting rod 37 which is fastened to traverser 12 with guide mechanism 38 that are only shown schematically. In addition, a suction and blower device that is not shown in more detail can also be attached to gripper head 35. The functioning of this web guidance device can be described as follows. Gripper head 35 is driven into a position A so that it is opposite of nip 25. The beginning of a paper web, which moves through nip 25, is suctioned and clamps as soon as it reaches position B. Gripper head 35 is then withdrawn with guide rod 37 (arrow C). Afterwards, traverser 12 is driven downwards parallel to plane 6 (arrow D). Guide rod 37 is then located in the position that is shown as a dashed line. It is also possible to drive holding device 38 on traverser 12 in order to reach this position. During the movement (D) or subsequent to it, gripper head 35 is rotated 180°, namely around an axis 45 (see FIG. 5) running parallel to the axes of the rolls. Then, the tip of the paper web is again directed at roll stack 2. Afterwards, guide rod 37 with gripper head 35 is advanced in the direction of the arrow F until the tip of next nip 27 is adjacent. The gripper is unlocked and the paper web is blown through nip 27.

The gripper appropriately engages the tip of the paper web from the side in doing so. In this case, it is always possible to direct this tip in the correct direction.

Figure 4:
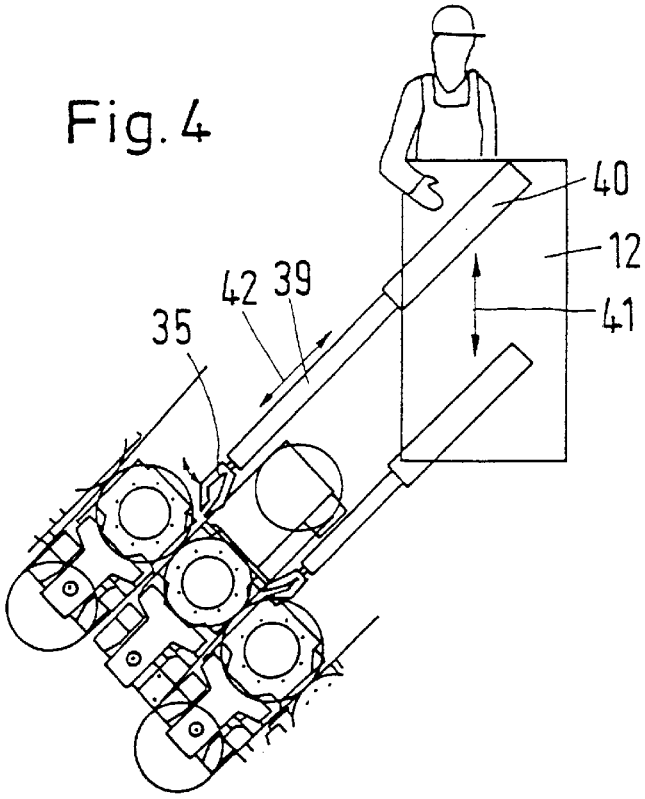
FIG. 4 shows a section with an embodiment which is modified from FIG. 3.

FIG. 4 now shows another possible embodiment. Gripper head 35 is fastened to piston rod 39 of a hydraulic or pneumatic cylinder 40. Cylinder 40 can be moved up and down on traverser 12 in the direction of arrow 41 in order to occupy the positions shown in FIG. 4 in front of and behind the nip. The gripper head can be moved by cylinder 40 in the direction of double arrow 42. Of course, it is also possible to combine the movement in the direction of arrows 41 and 42. In this case, a purely rectangular movement does not occur, rather it is also possible to create a curved movement path such as a circular path.

Figure 5:
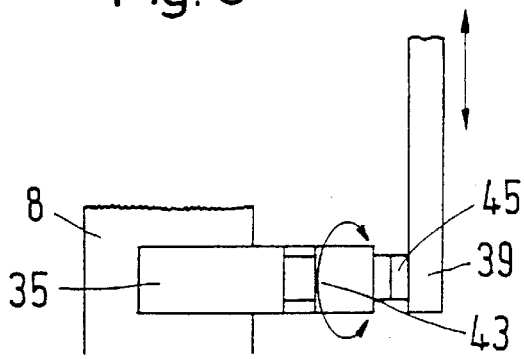
FIG. 5 shows a top view of a gripper head according to FIG. 4.
Figure 6:
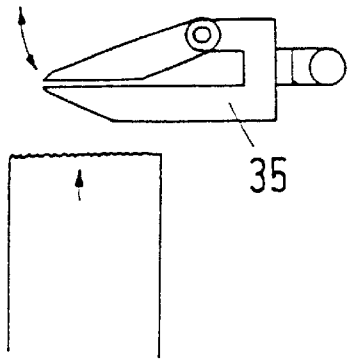
FIG. 6 shows a side view of a gripper head.

FIG. 5 shows gripper head 35 on the front end of piston rod 39 as it engages the tip of paper web 8 from the side. If gripper head 35 is now rotated 180°, as shown by an arrow 43, the tip of web of paper 8 is guided around the corresponding guide roller 9, 10. FIG. 6 illustrates the gripper head from the side. Only the suction and blower devices are not recognizable here.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent strictures, methods and uses, such as are within the scope of the appended claims.

What is claimed is:

1. A web guidance device for a calender which includes a roll stack having several rolls which form a plurality of nips, the device comprising:

a movable web guidance device which is fixable in at least one insertion position and arranged on at least one side of the roll stack; and the web guidance device receiving a beginning of the web at one nip of the plurality of nips and guiding the beginning of the web to another nip of the plurality of nips, wherein the web guidance device guides the beginning of the web through the roll stack, and wherein the web guidance device is movable between the at least one insertion position and at least one other insertion position.

2. The device of claim 1, wherein the calender comprises a material web treating calender.

3. The device of claim 1, wherein the web guidance device is fixable in a parked position in which no nip is covered by the web guidance device.

4. The device of claim 1, wherein the web guidance device further comprises a guide surface arrangement.

5. The device of claim 4, wherein the guide surface arrangement comprises at least one moveable guide surface for guiding the web.

6. The device of claim 1, wherein the roll stack is inclined at an angle.

7. The device of claim 6, wherein the angle is in the range of approximately greater than 0 degrees and less than 90 degrees.

8. A web guidance device for a calender which includes a roll stack having several rolls which form a plurality of nips, the device comprising:

a movable web guidance device which is fixable in at least one insertion position and arranged on at least one side of the roll stack; and a traverser coupled to the moveable web guidance device, wherein the web guidance device guides a beginning of the web through the roll stack, and wherein the web guidance device is movable between the at least one insertion position and at least one other insertion position.

9. The device of claim 8, wherein the web guidance device is fastened to the traverser.

10. A web guidance device for a calender which includes a roll stack having several rolls which form a plurality of nips, the device comprising:

a movable web guidance device which is fixable in at least one insertion position and arranged on at least one side of the roll stack, wherein the web guidance device guides a beginning of the web through the roll stack, and further comprising position switches for detecting the position of the web guidance device, the position switches being connected with a drive control.

11. A web guidance device for a calender which includes a roll stack having several rolls which form a plurality of nips, the device comprising:

a movable web guidance device which is. fixable in at least one insertion position and arranged on at least one side of the roll stack, wherein the web guidance device guides a beginning of the web through the roll stack, wherein the web guidance device further comprises a guide surface arrangement, wherein the guide surface arrangement comprises at least one moveable guide surface for guiding the web, and wherein at least one moveable guide surface comprises an evenly formed surface which runs essentially parallel to a stack plane, the stack plane running through a center axis of at least two rolls in the roll stack.

12. The device of claim 11, wherein the guide surface arrangement further comprises a reversing surface extending from the evenly formed surface.

13. The device of claim 12, wherein the reversing surface is moveable to a position. parallel to the evenly formed surface.

14. The device of claim 13, wherein the reversing surface is arranged on pivoted levers.

15. The device of claim 13, wherein the reversing surface is arranged on a sliding piece which is moveable in a direction substantially perpendicular to the stack plane.

16. A web guidance device for a calender which includes a roll stack having several rolls which form a plurality of nips, the device comprising:

a movable web guidance device which is fixable in at least one insertion position and arranged on at least one side of the roll stack; and the web guidance device receiving a beginning of the web at one nip of the plurality of nips and guiding the beginning of the web to another nip of the plurality of nips, wherein the web guidance device guides a beginning of the web through the roll stack, wherein the web guidance device further comprises a guide surface arrangement, and wherein the guide surface arrangement further comprises at least one tongue for engaging the beginning of the web, the at least one tongue being moveable in a direction substantially perpendicular to a stack plane, the stack plane running through a center axis of at least two rolls in the roll stack.

17. A web guidance device for a calender which includes a roll stack having several rolls which form a plurality of nips, the device comprising:

a movable web guidance device which is fixable in at least one insertion position and arranged on at least one side of the roll stack; and the web guidance device receiving a beginning of the web at one nip of the plurality of nips and guiding the beginning of the web to another nip of the plurality of nips, wherein the web guidance device guides a beginning of the web through the roll stack, and wherein the web guidance device further comprises at least one moveable gripper head for engaging the beginning of the web.

18. The device of claim 17, wherein the gripper head is moveable in a direction substantially perpendicular to a stack plane, the stack plane running through a center axis of at least two rolls in the roll stack.

19. A web guidance device for a calender which includes a roll stack having several rolls which form a plurality of nips, the device comprising:

a movable web guidance device which is fixable in at least one insertion position and arranged on at least one side of the roll stack, wherein the web guidance device guides a beginning of the web through the roll stack, wherein the web guidance device further comprises at least one moveable gripper head for engaging the web beginning, and wherein the gripper head is moveable along a arcuate path relative to the stack plane.

20. A web guidance device for a calender which includes a roll stack having several rolls which form a plurality of nips, the device comprising:

a movable web guidance device which is fixable in at least one insertion position and arranged on at least one side of the roll stack, wherein the web guidance device guides a beginning of the web through the roll stack, wherein the web guidance device further comprises at least one moveable gripper head for engaging the beginning of the web, wherein the gripper head is moveable in a direction substantially perpendicular to a stack plane, the stack plane running through a center axis of at least two rolls in the roll stack, and wherein the gripper head is moveable in a direction substantially parallel to the stack plane.

21. The device of claim 20, wherein the gripper head comprises one of a suction and a blower device for engaging the web beginning.

22. The device of claim 20, wherein the gripper head is rotatable for at least 180° around an axis running parallel to an axis of at least one roll in the roll stack.

23. The device of claim 22, wherein the gripper head comprises jaws which are oriented substantially parallel to an axis of at least one roll in the roll stack.

24. A device for threading a material web through a calender which comprises a roll stack having at least a first nip and a second nip, the device comprising:

a platform which is moveable relative to the roll stack and arranged on one side of the roll stack; and a web guidance device coupled to the platform;

wherein the web guidance device is adapted to redirect the direction of the material web after the web passes through the first nip, and wherein the web guidance device is movable between at least the first nip and at least the second nip.

25. The device of claim 24, wherein the platform comprises a traverser for carrying a operating personnel.

26. The device of claim 25, wherein the traverser is moveable in a direction parallel to a stack plane, the stack plane running through a center axis of at least two rolls in the roll stack.

27. The device of claim 24, wherein the web guidance device comprises at least one pivoting lever having a guide surface for engaging the web.

28. The device of claim 27, wherein the web guidance device comprises two pivoting levers each having a guide surface for engaging the web.

29. The device of claim 28, wherein the guide surface of each lever is curved whereby the web is guided to the second nip after reversing direction.

30. The device of claim 29, wherein the web guidance device further comprises a linear guide coupled to the pivoting levers, the linear guide being oriented parallel to a stack plane, the stack plane running through a center axis of at least two rolls in the roll stack.

31. The device of claim 30, wherein the web guidance device further comprises fluid activated cylinders for moving the pivoting levers.

32. The device of claim 24, wherein the web guidance device comprises at least one sliding mechanism having a guide surface for engaging the web.

33. The device of claim 32, wherein the web guidance device comprises at least two sliding mechanisms each having a guide surface for engaging the web.

34. The device of claim 33, wherein the guide surface of each sliding mechanism is curved whereby the web is guided to the second nip after reversing direction.

35. The device of claim 34, wherein the web guidance device further comprises a linear guide coupled to the pivoting levers, the linear guide being oriented parallel to a stack plane, the stack plane running through a center axis of at least two rolls in the roll stack.

36. The device of claim 34, wherein at least one sliding mechanism further comprises a tongue disposed at one end of the at least one sliding mechanism for engaging the web, the tongue being retractable into the sliding mechanism.

37. The device of claim 24, wherein the web guidance device comprises at least one guiding mechanism having an end for engaging the web.

38. The device of claim 37, wherein the guiding mechanism comprises a connecting rod which is moveable in a direction substantially perpendicular to a stack plane, the stack plane running through a center axis of at least two rolls in the roll stack.

39. The device of claim 24, wherein the platform travels along a path which is parallel to a stack plane, the stack plane running through a center axis of at least two rolls in the roll stack.

40. A device for threading a material web through a calender which comprises a roll stack having at least a first nip and a second nip, the device comprising:

a platform which is moveable relative to the roll stack and arranged on one side of the roll stack; and a web guidance device coupled to the platform;

wherein the web guidance device is adapted to redirect the direction of the material web after the web passes through the first nip, wherein the web guidance device comprises at least one guiding mechanism having an end for engaging the web, wherein the guiding mechanism comprises a connecting rod which is moveable in a direction substantially perpendicular to a stack plane, the stack plane running through a center axis of at least two rolls in the roll stack, and wherein the connecting rod comprises a gripper head for engaging a beginning end of the web.

41. The device of claim 40, wherein the gripper head comprises a pair of rotating jaws for reversing the direction of the web.

42. The device of claim 40, wherein the gripper head comprises one of a suction and a blower device for engaging the web beginning.

43. A device for threading a material web through a calender which comprises a roll stack having at least a first nip and a second nip, the device comprising:

a platform which is moveable relative to the roll stack and arranged on one side of the roll stack; and a web guidance device coupled to the platform;

wherein the web guidance device is adapted to redirect the direction of the material web after the web passes through the first nip, wherein the platform travels along a path which is parallel to a stack plane, the stack plane running through a center axis of at least two rolls in the roll stack, and wherein the path further comprises position switches for detecting the position of one of the platform and the web guidance device.

44. The device of claim 43, wherein the position switches are connected to a drive control device.

45. A device for threading a material web through a calender which comprises a roll stack having at least a first nip and a second nip, the device comprising:

a platform which is moveable along a travel path, the travel path being parallel to a stack plane whereby the stack plane runs through a center axis of at least two rolls in the roll stack;

a web guidance device coupled to the platform, the platform being arranged on one side of the roll stack;

the path comprising position sensors for detecting the position of one of the platform and the web guidance device; and a mechanism disposed on the web guidance device for changing a first direction of the web exiting the first nip to a second direction entering the second nip.

46. A method of threading a material web through a calender which comprises a roll stack having at least a first nip and a second nip, the method comprising:

feeding a web beginning through a first nip from one side of the roll stack;

engaging the web beginning on the other side of the roll stack with a web guidance device; and guiding the web beginning to a second nip with the web guidance device, wherein the web guidance device is mechanized and movable between at least the first nip and at least the second nip.

47. The method of claim 46, wherein the web guidance device is coupled to a moving platform.

48. The method of claim 47, wherein the guiding further comprises reversing the direction of the web beginning.

49. The method of claim 46, wherein the engaging further comprises pivoting at least one lever having a web guiding surface.

50. The method of claim 49, wherein the engaging further comprises pivoting two levers each having a web guiding surface.

51. The method of claim 46, wherein the engaging further comprises moving at least one sliding mechanism substantially perpendicular to a stack plane, the stack plane running through a center axis of at least two rolls in the roll stack.

52. The method of claim 46, further comprising moving the web guidance device from a parked position to a first position for initially engaging the web beginning.

53. The method of claim 46, wherein the first and second nips are separated in the roll stack by at least one intermediate nip.

54. The method of claim 53, wherein the first and second nips are separated-in the roll stack by at least two intermediate nips.

55. The method of claim 46, wherein the first and second nips are separated in the roll stack by at least two intermediate nips.

56. A method of threading a material web through a calender which comprises a roll stack having at least a first nip and a second nip, the method comprising:

feeding a web beginning through a first nip from one side of the roll stack;

engaging the web beginning on the other side of the roll stack with a web guidance device; and guiding the web beginning to a second nip with the web guidance device, wherein the web guidance device is coupled to a moving platform, wherein the guiding further comprises reversing the direction of the web beginning, and wherein the engaging further comprises gripping the web beginning with a gripper head disposed on the end of the web guidance device.

57. The method of claim 56, wherein the gripping further comprises vacuum retaining the web beginning.

58. The method of claim 56, wherein the gripping further comprises rotating the web beginning approximately 180 degrees.

59. A method of threading a material web through a calender which comprises a roll stack having at least a first nip and a second nip, the method comprising:

feeding a web beginning through a first nip from one side of the roll stack;

engaging the web beginning on the other side of the roll stack with a web guidance device;

guiding the web beginning to a second nip with the web guidance device, and detecting the position of the web guidance device with position sensors disposed along a web guidance device travel path.

60. A method of threading a material web through a calender which comprises a roll stack having at least a first nip and a second nip, the method comprising:

moving a web guidance device from a parked position to a first position adjacent the first nip;

detecting the first position with a position sensor;

feeding a web beginning through a first nip from one side of the roll stack;

engaging the web beginning on the other side of the roll stack with the web guidance device;

changing the direction of the web beginning with the guidance device; and moving the web guidance device back to a parked position.

* * * * *